United States Patent [19]

Visser et al.

[11] Patent Number: 4,816,138

[45] Date of Patent: Mar. 28, 1989

[54] PROCESS FOR CLEANING OF TOXIC WASTE MATERIALS BY REFINING AND/OR ELIMINATION OF BIOLOGICALLY DIFFICULT TO DEGRADE HALOGEN, NITROGEN AND/OR SULFUR COMPOUNDS

[75] Inventors: Leo Visser, Ve Rockanje; Ashok S. Laghate, Zoetermeer, both of Netherlands

[73] Assignee: Kinetics Technology International B.V., Zoetermeer, Netherlands

[21] Appl. No.: 915,639

[22] Filed: Oct. 6, 1986

Related U.S. Application Data

[63] Continuation-in-part of Ser. No. 774,908, Sep. 11, 1985, abandoned.

[30] Foreign Application Priority Data

Sep. 14, 1984 [NL] Netherlands ..... 8402837

[51] Int. Cl.[4] ..... C10M 175/00

[52] U.S. Cl. ..... 208/179; 208/251 H; 208/254 H; 208/216 R; 208/262.1; 208/262.5; 210/663; 210/664; 210/669; 210/668; 210/909

[58] Field of Search ..... 208/262, 251 R, 251 H, 208/254 R, 254 H, 216 R; 210/663, 664, 669, 668, 909

[56] References Cited

U.S. PATENT DOCUMENTS

| | | | |
|---|---|---|---|
| 2,314,621 | 3/1943 | Kelley | 210/669 |
| 2,446,489 | 8/1948 | Schaafsma | 208/262 |
| 2,687,985 | 8/1954 | Porter et al. | 208/262 |
| 3,876,533 | 4/1975 | Myers | 208/251 H |
| 3,919,076 | 11/1975 | Cutler et al. | 208/180 |
| 3,925,193 | 12/1975 | Constantikes et al. | 208/262 |
| 3,975,259 | 8/1966 | Doelp | 208/216 |
| 3,980,551 | 9/1976 | Walk | 208/179 |
| 4,090,951 | 5/1978 | Smith | 208/254 R |
| 4,097,369 | 6/1978 | Ebel et al. | 208/180 |
| 4,269,694 | 5/1981 | Holland et al. | 48/48 R |
| 4,276,179 | 6/1981 | Soehngen | 210/909 |
| 4,343,693 | 8/1982 | Holland et al. | 208/254 R |
| 4,344,841 | 8/1982 | Johnson | 208/254 R |
| 4,512,878 | 4/1985 | Reid et al. | 208/179 |
| 4,526,677 | 7/1985 | Grantham et al. | 210/909 |

FOREIGN PATENT DOCUMENTS

| | | | |
|---|---|---|---|
| 3433336 | 3/1985 | Fed. Rep. of Germany | 208/180 |
| 7711298 | 4/1979 | Netherlands | 208/180 |
| 1730562 | 5/1955 | United Kingdom | 208/211 |

*Primary Examiner*—W. J. Shine
*Assistant Examiner*—Helane Myers
*Attorney, Agent, or Firm*—Ladas & Parry

[57] ABSTRACT

The invention concerns a process for converting toxic liquid waste materials containing harmful amounts of biologically difficult to degrade toxic waste materials containing organic halogen compounds, and which also may contain organically bound oxygen, nitrogen and/or sulfur, into an innocuous hydrocarbon stream. These waste materials together with hydrogen are passed over a hydrogenating catalyst at 250°–400° C. and under increased pressure. The effluent of this hydrogenolysis is cooled and separated into a non-toxic liquid hydrocarbon stream, a hydrogen halogenide, ammonia, and/or a hydrogen sulfide containing stream and a gaseous stream of light hydrocarbons and hydrogen. The waste material which contains 0.5–60 weight % halogen and possibly contains up to 10% sulfur and/or small amounts of nitrogen-containing compounds is conditioned and this conditioned stream is passed, together with hydrogen under a prssure of 30–80 bar and with a LHSV of 0.5–2.5 $H^{-1}$, over a column filled with absorbent, to guard the hydrogenating catalyst, and subsequently over the hydrogenating catalyst.

15 Claims, 3 Drawing Sheets

PROCESS FOR CLEANING OF TOXIC WASTE MATERIALS BY REFINING AND/OR ELIMINATION OF BIOLOGICALLY DIFFICULT TO DEGRADE HALOGEN, NITROGEN AND/OR SULFUR COMPOUNDS

This is a continuation-in-part of co-pending application Ser. No. 774,908 now abandoned.

The invention concerns a process for converting toxic liquid waste materials containing harmful amounts of biologically difficult to degrade toxic waste materials containing organic halogen compounds, and which also may contain organically bound oxygen, nitrogen and/or sulfur, into an innocuous hydrocarbon stream. These waste materials together with hydrogen are passed over a hydrogenating catalyst at 250°-400° C. and under increased pressure. The effluent of this hydrogenolysis is cooled and separated into a non-toxic liquid hydrocarbon stream, a hydrogen halogenide, ammonia, and/or a hydrogen sulfide containing stream and a gaseous stream of light hydrocarbons and hydrogen. The waste material which contains 0.5-60 weight % halogen and possibly contains up to 10% sulfur and/or small amounts of nitrogen-containing compounds is conditioned and this conditioned stream is passed, together with hydrogen under a pressure of 30-80 bar and with a LHSV of 0.5-2.5$H^{-1}$, over a column filled with absorbent, to guard the hydrogenating catalyst, and subsequently over the hydrogenating catalyst.

There are a great variety of wastes containing compounds which are biologically difficult to degrade and contain halogen, and/or nitrogen or sulfur compounds. We can first classify wastes into sOlid and liquid waste materials.

Liquid waste materials can e divided into water-containing wastes and wastes which are substantially water free. If halogen nitrogen and/or sulfur contained in an aqueous waste material are bonded to hydrocarbons, those hydrocarbons can be separated from the water, after which the separated hydrocarbons can be treated.

Many liquid halogen-, nitrogen- and/or sulfur-containing waste materials, like waste materials from the metal industry, are treated by distillation, a process which leaves a solid halogen-, nitrogen- and/or sulfur-containing waste material.

Another part of the liquid fractionconsists of all kinds of biologically difficult to degrade halogen, nitrogen and/or sulfur compounds which are often mixed with other organic compounds. Polychlorinated biphenyls (PCB's), for example, have frequently been detected in waste oils; their origin is, for example, transformer oil.

Nowadays, most halogen-, nitrogen- and/or sulfur-containing waste materials are disposed of by burning in special incinerators to prevent the formation of compounds like dioxines.

Further, it has been proposed to decompose halogen-containing waste materials by catalytic hydrogenolysis.

According to Japanese Pat. Nos. 7445043 and 7413155, polychlorinated biphenyls (PCB's) are decomposed by hydrogenation in the presence of a noble catalyst, e.g., a platinum metal catalyst. Japanese Pat. No. 746113 describes the decomposition of PCB's by heating this compound in aqueous hydrazine in an inert solvent and in the presence of a palladium catalyst.

Noble metal catalysts, however, are sensitive to poisoning and, in practice, show only a moderate degree of conversion. The use of hydrazine is problematic because of the toxicity of hydrazine.

It is also known from U.S. Pat. No. 4,400,566 that halogen-containing waste materials in an aprotic solvent can be converted with hydrogen in the presence of a catalyst containing (a) nickel compounds with zero valent nickel, in which no N-O bonds are present; (b) triarylfosfines; (c) a reduction agent (e.g., a metal) maintaining the zero valent nickel state and (d) halogenide ions. The catalyst used is complex and necessitates a careful control of the process.

It is known from Japanese Pat. No. 7413155 that PCB's can be decomposed by hydrogenolysis in the presence of catalysts based on metals from the iron group (Fe, Ni, Co) plus molybdenum and in the presence of aqueous sodium hydroxide. It is also know that, in practice, under these conditions the catalyst is deactivated after a short while. It is assumed that the use of the sodium hydroxide solution, to bind the hydroben halogenides, hydrogen sulfide and hydrogen cyanide formed, leaves insufficient hydrogen sulfide to keep the Ni-Mo catalyst in the sulfided state.

The heart of the instant invention is the finding that a toxic liquid waste material containing biologically difficult to degrade organic halogen compounds which may also contain organically bound oxygen, nitrogen and/or sulfur can be cleaned by refining and/or elimination by catalytic hydrogenolysis of these compounds which are decomposed with formation of hydrogen halogenide, ammonia or hydrogen sulfide respectively. The process provides the formation of a cleaned hydrocarbon stream containing less than 10 mg/kg halogen, less than 1 ppm wt. polychlorobiphenyls (PCB's), less than 0.15 wt.% sulfur and traces of nitrogen. Thisprocess provides a useful hydrocarbon product, without the problems of catalyst fouling. The toxic waste stream contaminated, which contains 0.5-60 wt.% halogen, up to 10 wt.% sulfur and/or small amounts of nitrogen-containing compounds is first conditioned and the conditioned stream together with hydrogen under a pressure of 30-80 bar and at an LHSV of 0.5-2.5$H^{-1}$ is passed over a column filled with absorbent to guard the hydrogenating catalyst and subsequently over the hydrogenation catalyst.

Some examples of contaminants in the toxic liquid waste are: polychlorobiphenyls (PCB), polychloroaromatics (PCA), polychlorodibenzodioxines (PCDD) and polychlorodibenzofurans (PCDF).

The catalytic hydrogenolysis is sensitive to the presence of metals and metal salts that might be present (inhibition or fouling of the catalyst). For this reason, a well-defined feed is necessary, and this is attained by analyzing the impurities present in the feed and conditioning of the feed on the basis of the data obtained from this analysis. In many cases, e.g. in the case of gas oil contaminated with halogen and sulfur compounds, it is sufficient to filter the waste stream in order to separate sludge-like contaminants (metal, carbon).

Optimum conditioning is obtained by filtration and vacuum distillation of the hydrocarbon stream in which the top product of the vacuum distillation after separation of gaseous components serves as the feed for the hydrogenation step.

Preferably the vacuum distillation is performed in two wiped film evaporators in series, in which the bottom product of the first film evaporator is the feed material for the second one. This gives the best results. Subsequently, the conditioned feed is mixed with hydrogen in such a way that a ratio of hydrogen to halogen and, optionally, nitrogen, or sulfur compounds to hydrocarbons is obtained suitable for hydrogenolysis, and by passing these through a column filled with absorbent in which potential catalyst poisons are effectively absorbed, in whichever manner the hydrogenation catalyst obtains a longer lifetime and the process is suitable for application on a technical scale.

The adsorbents can be active carbon or, preferably, an active metal oxide with a large specific area. Granular aluminum oxide is very suitable with a large porosity which guards the catalysts perfectly in such a way that the catalyst has a long lifetime.

All possible types of hydrogenating catalysts may be applied as catalysts according to the process. Noble metal catalysts, like catalysts based on metals from the platinum group, however, are not preferred because, as mentioned before, they give a moderate conversion and are rapidly deactivated. A catalyst consisting of an inert carrier (e.g., silica, alumina or a mixture of silica and alumina, aluminum silicate or similar materials), impregnated with an activating metal in the oxide or salt form, e.g. nickel oxide, magnesium sulfate, barium chloride, is very suitable. Excellent results are particularly obtained with catalysts based on metals from the iron group (Fe, Ni, Co) together with tungsten or rhenium or, in particular, molybdenum. Therefore, preferably, catalysts of this type are used. The metal from the iron group and molybdenum, tungsten or rhenium are, preferably, deposited on an inert carrier (e.g., silica, alumina, aluminum silicate) and are generally present in the oxidic state.

Before using, the catalysts are, preferably, conditioned with sulfur-containing compounds such that the catalyst remains sulfided during the hydrogenolysis.

The temperature in the hydrogenolysis reactor must be at least 250° C., because, otherwise, the reaction with certain types of organic compounds is too slow and incomplete. Optimum results are obtained at temperatures between 250° C. and 400° C.; the conversion of waste materials is then above 99% at an LHSV between $0.5-2.5H^{-1}$.

The effluent of the hydrogenolysis reaction is cooled directly or indirectly, in order to separate the hydrogen fraction and the aqueous phase, with by-products such as HCL, $H_2S$ and $NH_3$, from the mainstream. When indirect cooling is applied, the usual cooling agents may be used. When using direct cooling, water is an excellent cooling agent as it has a good heat capacity. The use of water as a coolant, however, necessitates special measures, because water is also a solvent for by-products of the reaction such as HCl $H_2S$, and water vapor formed with HCl and $H_2S$ may give corrosion problems.

Another suitable cooling agent is a cold hydrocarbon. HCl and $H_2S$ are not, or are barely, soluble in such hydrocarbons and HCl and $H_2S$ in a hydrocarbon atmosphere are not at all or barely, corrosive.

The gaseous effluent of the hydrogenolysis reaction after cooling is separated into a hydrogen and possiblly lighter hydrocarbon containing phase, a liquid hydrocarbon phase and a hydrogen halogenide(s), nitrogen, sulfur compounds and similar compounds containing phase.

Hereto the effluent is, for example, separated into a liquid (hydrocarbon) phaase and a gaseous phase, and subsequently the gaseous phase is, for example, passed through an absorbance for the hydrogen halogenide(s), nitrogen or sulfur compounds. Water is preferred as an absorbent, since it is cheap and easily available and forms an excellent solvent.

The hydrogen and possibly lighter hydrocarbons containing phase remaining is recycled and, after completion with fresh hydrogen, mixed with the conditioned feed.

The invention is elucidated in but not restricted to the following examples and by the following figures.

FIG. 1 showsschematically an installation for the process according to the invention, in which filtration is used as conditioning treatment and in which the separation yields an aqueous solution of hydrogen halogenides.

FIG. 3 shows schematically a mode of operation of the hydrogenolysis, preceded by a column with adsorbents, in which the hydrogenolysis proceeds in two steps with separation of formed by-products in between.

In the figures, corresponding parts are indicated with the same reference numbers. Apparatus like pumps, valves, control systems, etc. are not indicated.

Figure 1:
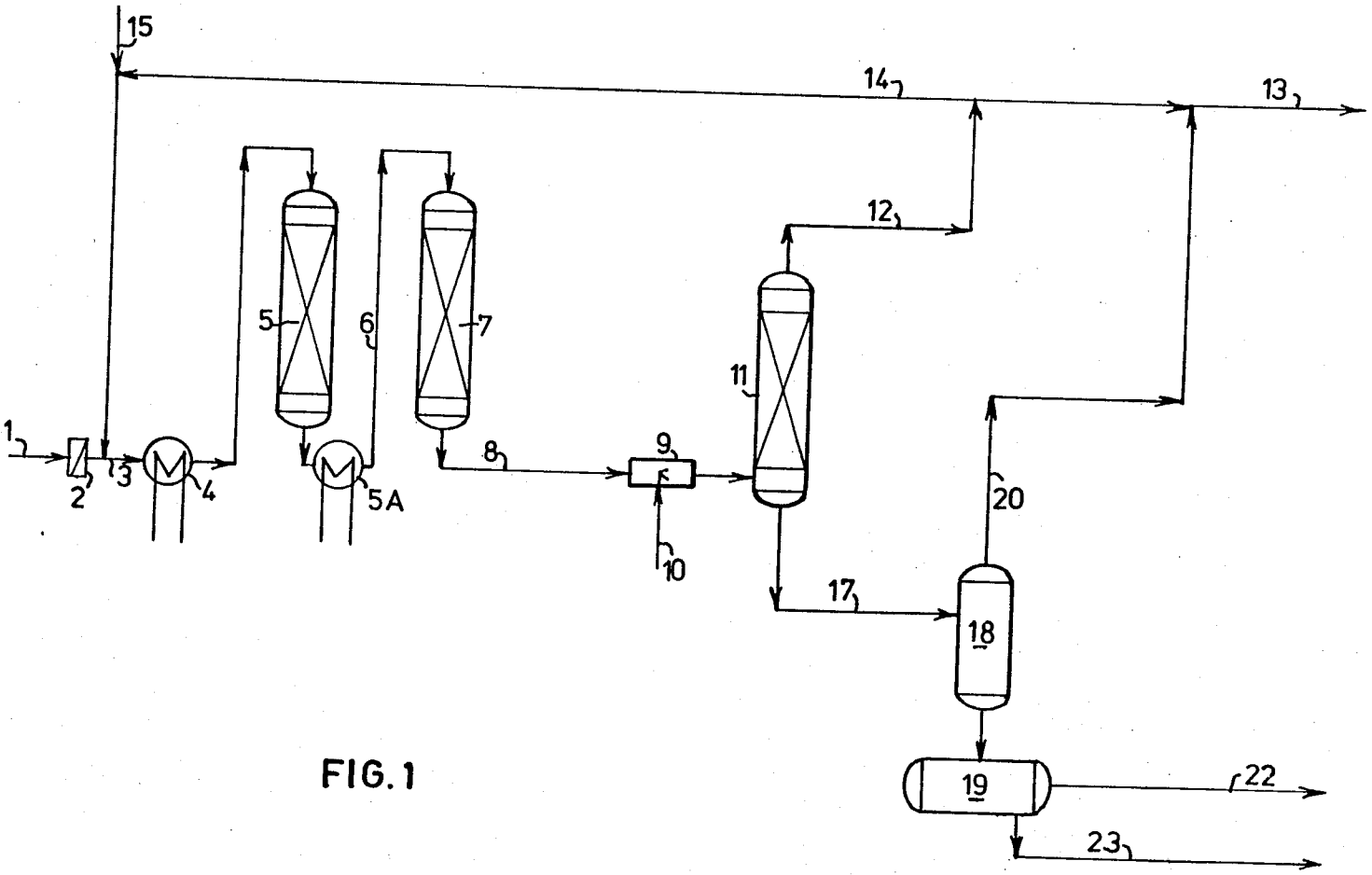

The installation of FIG. 1 is very suitable for the cleanup of lightly contaminated hydrocarbon mixtures.

The contaminated toxic waste mixtures, for example, gas oil contaminated by halogen compounds, which may also contain nitrogen and/or sulfur compounds supplied by line 1, are filtered in filter 2 and subsequently mixed with hydrogen from line 14 (as described later on), are passed to heat exchanger 4 via line 3. Herein the mixture is heated to a temperature of 250°–400° C., which temperature gives the best result in the subsequent adsorption and hydrogenolysis steps. Subsequently, the mixture is passed through a vertical column 5 filled with adsorbent (e.g., alumina of high porosity), in which way catalyst poisons are effectively adsorbed.

The mixture of contaminated hydrocarbon feed and hydrogen cooled slightly during absorption is passed subsequently via heat exchanger 5A in which it is heated ad by line 6 to a hydrogenolysis reactor 7, where the mixture at a temperature between 250° and 400° C. and under a pressure of 30–80 bar is contacted with a hydrogenating catalyst. The effluent from the hydrogenlysis reactor 7 passed through line 8 is cooled to a temperature of about 50° C. in cooler 9 by mixing the effluent with a coolant added through line 10 (e.g., water).

Subsequently, the mixture of water and effluent from the hydrogenolysis reaction enters separator 11, where, at a pressure of about 50 bar and a temperature of about 50° C., gaseous components (hydrogen and traces of methane, ethane and other hydrocarbons in the vapor state) are separated and discharged by line 12. Part of this gaseous stream is recycled by line 14 and, after suppletion with hydrogen from line 15, fed in line 3.

The remainder leaves the installation by line 13.

The liquid phase, consisting of liquid hydrocarbons and an aqueous phase in which hydrogen halogenide, ammonia and/or hydrogen sulfide are dissolved, is drained from the bottom of separator 11 via line 17 to expansion vessel 18, in which the pressure is lowered to about 2–10 bar. Hereby part of the hydrocarbons and traces of water and hydrogen sulfide evaporate. The vapor phase is discharged by line 20. The remaining liquid phase goes to a separator 19 where phase separation occurs. The hydrocarbon phase is discharged as a product by line 22. The bottom, aqueous phase is discharged by line 23.

The hydrocarbon vapor escapes by line 13 and is discharged.

Figure 2:
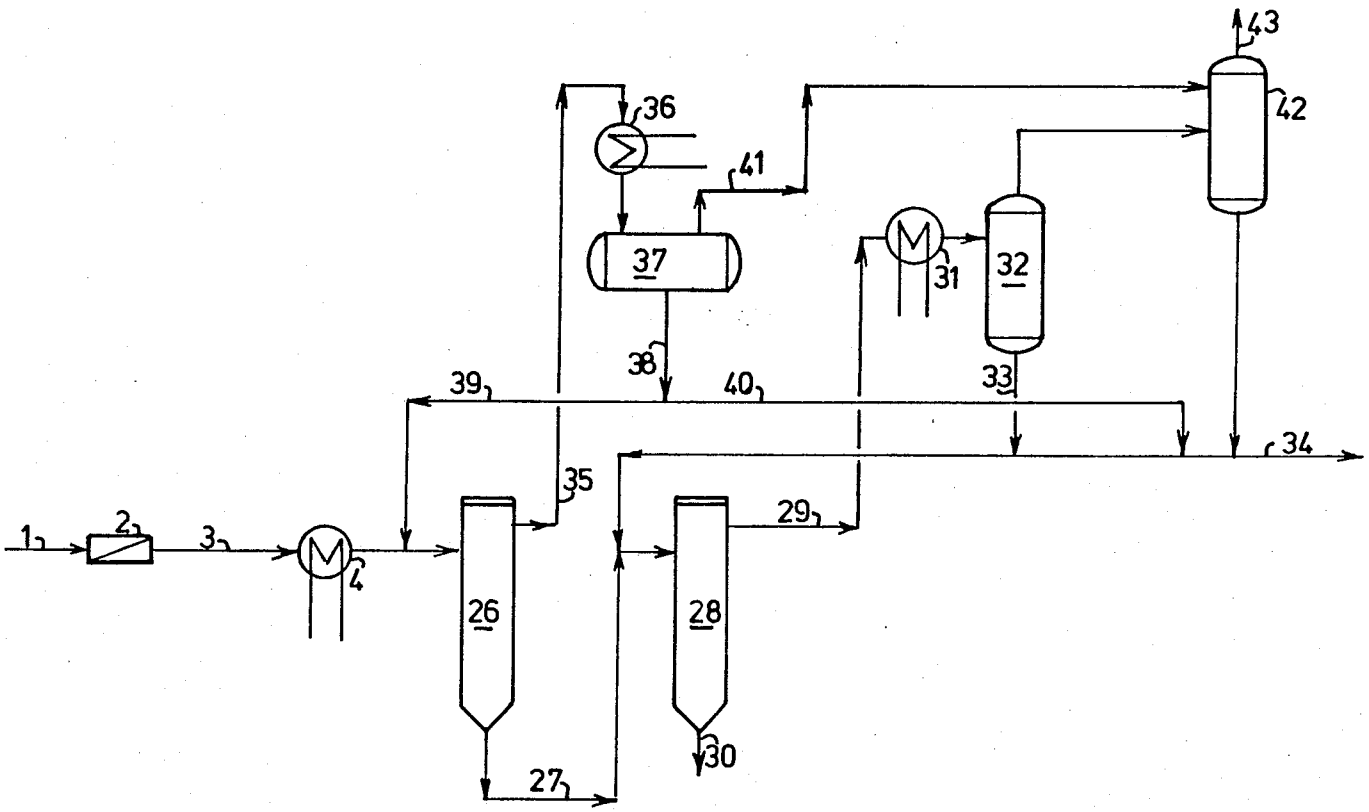
FIG. 2 shows schematically an installation, in which the conditioning treatment is a filtration followed by vacuum distillation in two wiped film evaporators in series.

In FIG. 2, a hydrocarbon mixture contaminated by halogen and nitrogen and/or sulfur compounds is supplied by line 1, filtered in filter 2 and passed from line 3 through a heat exchanger 4 where it is preheated to a temperature of about 100°-200° C.

Subsequently, it is fed to a wiped film evaporator 26, where a top product of light organic components (hydrocarbons, halogen, nitrogen and/or sulfur compounds) and possibly present traces of water are separated, which are discharged by line 35. The bottom fraction from film evaporator 26 goes through line 27 to a second wiped film evaporator 28, where this fraction is redistilled under a pressure between 0.005 bar and 0.15 bar (in particular 0.05-01 bar) in which way a tarry (sediment) fraction is obtained as bottom fraction which is discharged via line 30.

The top product from this column discharged by line 29 consists of hydrocarbons and halogen-, nitrogen- and/or sulfur containing compounds.

The top product stream from the first film evaporator 26 is passed via line 35 and condenser 36 to separator 37, in which a hydrocarbon and halogen-, nitrogen- and/or sulfur compounds-containing phase is separated which is partly recycled by line 39 and partly goes to the hydrogenolysis reactor by line 40 and line 34.

The aqueous phase from separator 37 is passed via line 41 to scrubber 42, in which an additional fraction for the hydrogenolysis is obtained.

The top product from film evaporator 28 is supplied via line 29 and condenser 31 also to a separator 32 in which a phase comprising hydrocarbon and halogen, nitrogen and/or sulfur compounds is separated and discharged by line 33. Part of this phase is recycled to the film evaporator; the remainder is supplied to the hydrogenolysis reactor by line 34. The volatile phase from separator 32 is discharged and supplied to scrubber 42, in which valuable components suitable for the hydrogenolysis are obtained and fed via line 34. Gaseous components are separated and discharged.

The product streams destined for the hydrogenolysis, e.g., from line 34, are mixed with hydrogen and subsequently passed to the hydrogenolysis system as shown in FIG. 1.

The product steams in line 34 originating from the conditioning system of FIG. 2, however, often contain a higher content of halogenide, nitrogen and/or sulfur compounds and, therefore can be treated advantageously in a two-stage hydrogenolysis.

Figure 3:
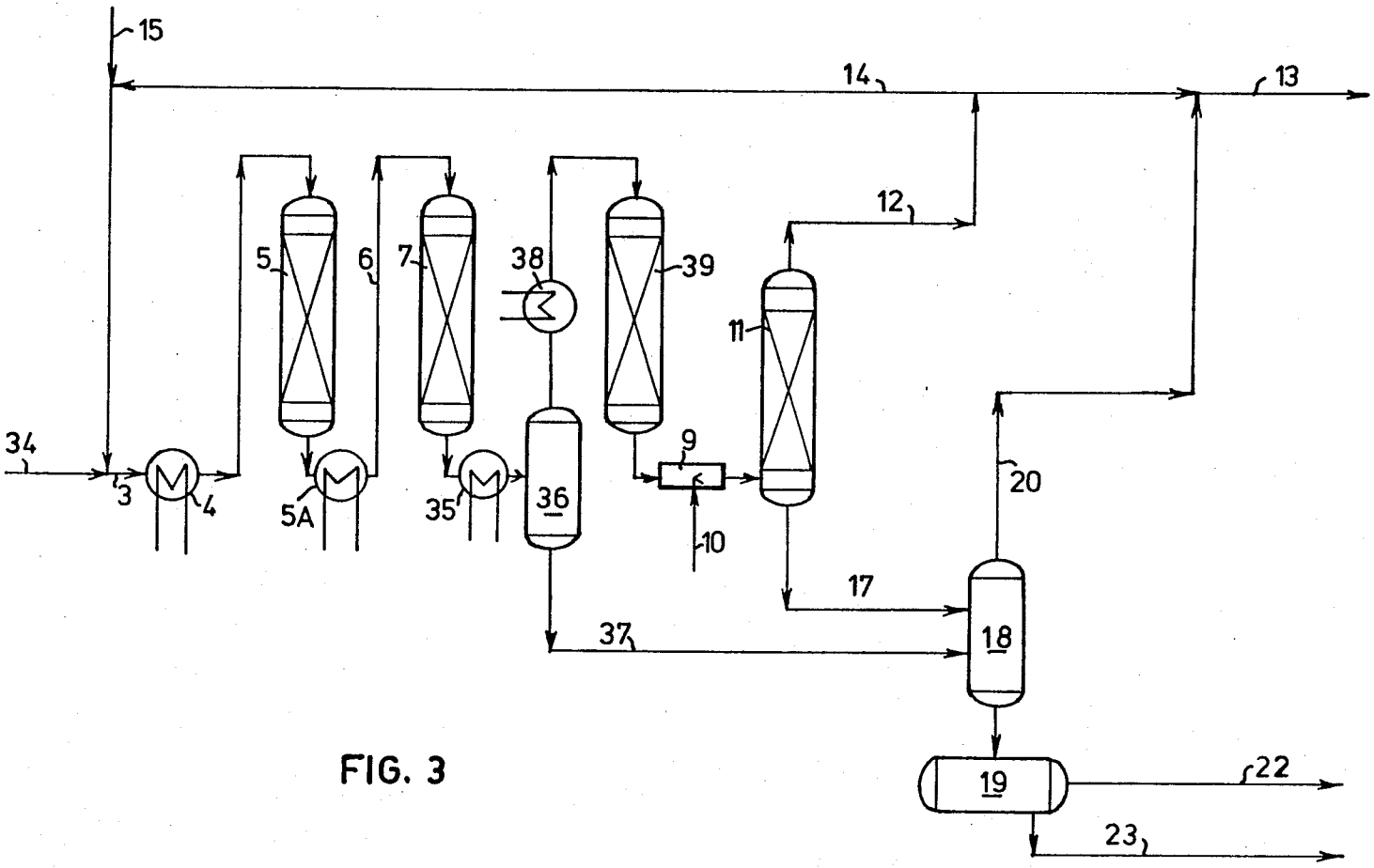

A suitable embodiment of such a two-stage hydrogenolysis has been depicted schematically in FIG. 3. The product stream from line 34, after mixing with hydrogen, is heated in heat exchanger 4 to a temperature of about 250° to 400° C., and the mixture is subsequently passed through column 5 filled with adsorbent. Via heat exchanger 5A in which the mixture, slightly cooled during adsorption, is reheated, it is passed through line 6 to a first hydrogenolysis reactor 7, in which the mixture at 250°-400° C. and under a pressure of 30-80 bar is contacted with hydrogenating catalyst.

The effluent from the hydrogenolysis reactor 7 is cooled by heat exchanger 35 and the hydrogen halogenide, ammonia and/or hydrogen sulfide formed are separated in separator 36 and discharged by line 37. The remaining mixture of hydrogen, hydrocarbons and remaining halogen, nitrogen and/or sulfur compounds is discharged from separator 36, heated to 250°-400° C. in heat exchanger 38 and supplied to a second hydrogenolysis reactor 39, where the mixture is contacted with a hydrogenating catalyst and the hydrogenolysis of the halogen, nitrogen and/or sulfur compounds is completed.

The effluent of this second hydrogenolysis reactor is cooled to about 50° C. by mixing of the effluent with a cooling agent, after which the cooled stream is separated in a similar way as discussed before when describing FIG. 1.

The hydrogen halogenide(s), ammonia and/or hydrogen sulfide separated in separator 36 are discharged via line 37 and fed to flash vessel 18 where they are mixed with the liquid phase from separator 11 consisting of hydrocarbons, hydrogen halogenide(s), ammonia and/or hydrogen sulfide and together with this liquid phase are subjected to the same separation unit operations.

EXAMPLE 1

An installatin as shown in FIG. 1 is used for the dechlorination and desulfurization of a contaminated gas oil. This gas oil has the following specifications:

Density 835 Kg/M$^3$
Chlorine content 1.5 weight %
PCB content 200 Mg/Kg
Sulfur content 0.7 weight %
Boiling trajectory °C.
Start 156
10 vol. % 188
30 vol. % 204
50 vol. % 242
70 vol. % 280
90 vol. % 347
End Approx. 395

This gas oil is dechlorinated and desulfurized in hydrogenolysis reactor 7 at 300° C. and a pressure of 50 bar (hydrogen pressure). The catalyst consists of alumina supported nickel and molybdenum presulfided with $H_2$-.

The following results are obtained under these conditions:

1. Starting material, gas oil with above-mentioned specifications 2500 Kg/Hr
   hydrogen 65 Nm$^3$/Hr
2. Product diesel oil 2120 Kg/Hr (quality according to ASTM D975 for diesel fuel) total chlorine max. 10
   Mg/Kg;
   PCB max. 1 Mg/Kg
   Temp. 50° C.
   Pressure 2 bar
   Sulfur content 0.15 weight % maximum
3. Petrol (gasoline) fraction 330 Kg/Hr boiling trajectory 35°-200° C., temperature 50° C.
   Pressure 1.5 bar
4. Waste streams;
   Sour fuel gas 35 Kg/Hr; sour waste water 261 Kg/Hr.

EXAMPLE 2

An experiment was conducted with an industrial waste stream of hydrocarbons contaminated with halogen containing compounds.

Analyis of this waste stream gave the following results:

| | |
|---|---|
| Density | 1.1646 |
| PH | 2.3 |
| X-ray analysis | chlorine 36.6 weight %<br>Br 0.6 weight %<br>Fe 0.6 weight %<br>Hg 0.1 ppm<br>F less than 5 ppm (A more accurate determination was impossible because of interference of Cl; presumably Nil.) |
| Traces | Ba, Ag, Zn, Cu, Cr, Ti, Si, J, S less than 1% |
| Water content | 11–12% |

Furthermore sodium is present (sodium and magnesium are insensitive to X-ray analysis).

Centrifugating at 1500 rpm results in: an upper layer consisting of 25% of the original sample containing 15.5% water, density at 20° C. is 1.115.

Middle layer 65%—density 1.17

Residue 10%. This sediment layer has not been further examined.

The following composition has been obtained from analysis results by means of column chromatography with carbon tetrachloride, tetrahydrofuran, methylethyl ketone and methanol as effluents:

19 wt.% water
2 wt.% salts, sodium, iron trichloride
1 wt.% soot and particles
3 wt.% methanol, ethanol, propanols, butanols
22 wt.% light chlorine compounds (up to perchloroethylene)
5 wt.% mineral spirit p.n.a.
22 wt.% light alcohols up from amylalcohol
oxitoles (low molecular)
glycols (low molecular)
chlorinated alcohols
2.6% mineral oil+chloroalkanes
8% heavy alcohols
heavy glycols
heavy oxitols
15 wt.% polyaromatics
polychlorinated aromatics
chlorinated phenols
esters This waste stream is conditioned by filtering, followed by a 2-stage distillation in an apparatus according to FIG. 2 and the obtained stream 34 was subsequently hydrogenolysed in two stages in an apparatus according to FIG. 3.

The conditions in and results from the distillation in the film evaporators were as follows:

| Film evaporator 26 | Film evaporator 28 |
|---|---|
| Atmosph. pressure 120° C. | Temperature 165° C. |
| Evaporated fraction 5% of the feed material | Top fraction suitable for hydrogenolysis: 80% of feed material<br>Residue 15% of the feed material |

Conditions in and results from hydrogenolysis:

| Hydrogenolysis Reactor 7 | Hydrogenolysis Reactor 39 |
|---|---|
| Cat. sulf. Ni + NO ON $AL_2O_3$ | Sulf. Ni + Mo ON $AL_2O_3$ |
| Temp. 300° C. | 350° C. |
| Pressure 60 bar | 55 bar |

-continued

| | |
|---|---|
| Conversion Abt. 90% | >99% |
| END PRODUCT | |
| Gas oil | |
| Total chlorine | ≦10 Mg/Kg |
| PCB's | ≦ wt. ppm |
| Sulfur | ≦0.15 wt. % |

We claim:

1. A process for converting toxic liquid waste materials containing harmful amounts of biologically difficult to degrade organic halogen compounds into an innocuous hydrocarbon stream consisting of conditioning a toxic liquid waste material containing organic halogen compounds which may also contain organically bound oxygen, nitrogen and/or sulfur, passing the conditioned material over a column filled with adsorbent to guard the hydrogenating catalyst and passing this liquid waste material together with hydrogen over a hydrogenating catalyst at 350°–400° C. under a pressure of 30–80 bar and with a LHSV (Liquid Hourly Space Velocity) of $0.5–2.5H^{-1}$, cooling the effluent of the hydrogenolysis and separating it into a non-toxic hydrocarbon stream and a stream containing one or more of a hydrogen halogenide or ammonia containing stream and a gaseous stream of light hydrocarbons and hydrogen, said toxic liquid waste stream comprising 0.5–60% by weight of halogen and 0–10% sulfur and 0 to trace amounts of nitrogen, said conditioning comprising filtering.

2. A process according to claim 1, whereinthe waste stream is subjected to vacuum distillation after filtration, in which the top product from the vacuum distillation, after separation of the gaseous components, serves as a feed for the hydrogenolysis step.

3. A process according to claim 2, wherein the vacuum distillation takes place in two wiped film evaporators in series, in which the bottom product of the first film evaporator forms the feed of the second one.

4. A process according to claim 1 wherein the absorbent comprises granular alumina.

5. A process according to claim 1 wherein the hydrogenating catalyst is based on metals of the iron group plus molybdenum, tungsten or rhenium being applied.

6. A process according to claim 5, wherein said catalyst comprises nickel or cobalt plus molybdenum supported on an inert carrier.

7. A process according to claim 6, wherein preceding the hydrogenation the catalyst is conditioned with a sulfur compound until the sulfided stage is reached.

8. A process according to claim 1, wherein at least part of the gaseous stream separated from the effluent leaving the column filled with hydrogenating catalyst is recycled.

9. A process according to claim 1, wherein two columns with catalyst are used and the by-products formed in the first column with catalyst are separated before passing the mixture of hydrocarbons and hydrogen through the second column with catalyst.

10. A process as in claim 1, wherein said organic halogen compounds which may also contain organically bound oxygen, nitrogen and/or sulfur comprise one or more of polychlorobiphenyls, polychloroaromatics, polychlorodibenzodioxines or polychlorodibenzurfurans.

11. A process as in claim 3, wherein said organic halogen compounds which may also contain organically bound oxygen, nitrogen and/or sulfur comprise one or more of polychlorobiphenyls, polychloroaromatics, polychlorodibenzodioxines or polychlorodibenzufurans.

12. A process ase in claim 7, wherein said organic halogen compounds which may also contain organically bound oxygen, nitrogen and/or sulfur comprise one or more of polychlorobiphenyls, polychloroaromatics, polychlorodibenzodioxines or polychlorodibenzufurans.

13. A process as in claim 4, wherein said organic halogen compounds which may also contain organically bound oxygen, nitrogen and/or sulfur comprise one or more of polychlorobiphenyls, polychloroaromatics, polychlorodibenzodioxines or polychlorodibenzufurans.

14. A process as in claim 10, wherein said resulting innocuous hydrocarbon stream comprises less than 10 mg/kg halogen, less than 1 ppm by weight of polychlorobiphenyls, less than 0.15 weight % sulfur and traces of nitrogen.

15. A process, as in claim 1 wherein the feed stream comprises 0 amount of nitrogen.

* * * * *